US005574489A

United States Patent [19]

Cowger et al.

[11] Patent Number: 5,574,489

[45] Date of Patent: Nov. 12, 1996

[54] INK CARTRIDGE SYSTEM FOR INK-JET PRINTER

[75] Inventors: Bruce Cowger; Ron Prevost, both of Corvallis, Oreg.

[73] Assignee: Hewlett-Packard Company, Palo Alto, Calif.

[21] Appl. No.: 221,318

[22] Filed: Mar. 30, 1994

[51] Int. Cl.[6] ..... B41J 2/175; B65B 1/04; B65D 25/08

[52] U.S. Cl. ..... 347/86; 222/81; 206/222; 141/313; 141/329

[58] Field of Search ..... 347/85, 86, 87, 347/7; 206/831, 222; 222/81, 88; 141/329, 10, 313

[56] References Cited

U.S. PATENT DOCUMENTS

| | | | |
|---|---|---|---|
| 3,452,361 | 6/1969 | Williams, Jr. . | |
| 3,708,798 | 1/1973 | Hildenbrand et al. | 347/86 |
| 4,383,263 | 10/1983 | Ozawa et al. | 347/30 |
| 4,394,669 | 7/1983 | Ozawa et al. | 347/86 |
| 4,419,678 | 12/1983 | Kasugayama et al. | 347/86 |
| 4,422,084 | 12/1983 | Saito | 347/7 |
| 4,429,320 | 1/1984 | Hattori et al. | 347/86 |
| 4,433,341 | 2/1984 | Thomas | 347/6 |
| 4,475,116 | 10/1984 | Sicking et al. | 347/86 |
| 4,496,959 | 1/1985 | Frerichs | 347/86 |
| 4,590,495 | 5/1986 | Okamura | 347/85 |
| 4,620,202 | 10/1986 | Koto et al. | 347/87 |
| 4,737,801 | 4/1988 | Ichihashi et al. | 347/85 |
| 4,831,389 | 5/1989 | Chan | 347/86 |
| 4,928,126 | 5/1990 | Asai | 347/86 |
| 4,931,812 | 6/1990 | Dunn et al. | 347/87 |
| 4,935,751 | 6/1990 | Hamlin | 347/86 |
| 4,959,667 | 9/1990 | Kaplinsky | 347/87 |
| 4,999,652 | 3/1991 | Chan | 347/86 |
| 5,040,001 | 8/1991 | Dunn et al. | 347/86 |
| 5,153,612 | 10/1992 | Dunn et al. | 347/87 |
| 5,187,498 | 2/1993 | Burger | 347/86 |
| 5,359,353 | 10/1994 | Hunt, et al. | 347/86 |
| 5,359,356 | 10/1994 | Ecklund | 347/86 |
| 5,425,478 | 6/1995 | Kotaki et al. | 347/86 |

FOREIGN PATENT DOCUMENTS

| | | | |
|---|---|---|---|
| 0496642 | 7/1926 | European Pat. Off. . | |
| 0419876 | 4/1991 | European Pat. Off. . | |
| 0553535 | 8/1993 | European Pat. Off. . | |
| 0604712 | 7/1994 | European Pat. Off. . | |
| 2742633A1 | 4/1979 | Germany . | |
| 3504216 | 8/1985 | Germany . | |
| 61-284445 | 12/1986 | Japan . | |
| 63-154356 | 6/1988 | Japan | 347/86 |
| 5-254138 | 10/1993 | Japan | 347/86 |
| 2003793 | 3/1979 | United Kingdom . | |
| 2063175 | 6/1981 | United Kingdom . | |
| 8606032 | 10/1986 | WIPO . | |

OTHER PUBLICATIONS

Xerox Disclosure Bulletin, vol. 16, No. 1, Jan. 1991, pp. 11–13, Fox, "Ink Container And Connection Valve For TIJ Printing System".

*Primary Examiner*—Benjamin R. Fuller
*Assistant Examiner*—Craig A. Hallacher

[57] ABSTRACT

The present invention is directed to a system that provides a replaceable cartridge for storing ink, in conjunction with a printer station for rapid and leak-free replacement of the cartridges.

20 Claims, 6 Drawing Sheets

212
200
206
211
210
208
220
224
10
202
10
158
222
104
61
184
108
168
170
180
190
19
118
156
100
174
114
186
122
120
160
166
164
162
106
150
112
22b
152
10

212
208
206
210
200
172
208
204
150
211
211
202
170
162
156
180
158
164
154
222
182
152

INK CARTRIDGE SYSTEM FOR INK-JET PRINTER

TECHNICAL FIELD

The present invention is directed to an ink cartridge system for a pen of an ink-jet type printer.

BACKGROUND INFORMATION

One type of ink-jet printer includes a carriage that is reciprocated back and forth across a sheet of paper that is advanced through the printer. The reciprocating carriage holds a pen very close to the paper. The pen is controlled by the printer for selectively ejecting ink drops from the pen while the pen is reciprocated or scanned across the paper, thereby to produce characters or an image on the paper.

The pen has a reservoir for holding a limited amount of ink. A relatively larger supply of ink is provided in a replaceable stationary container that is mounted to the printer. A tube may be connected between the supply container and the pen, thereby to conduct the flow of ink from the supply container to the pen for replenishing the pen reservoir as needed.

An efficient and easy-to-use printer will include mechanisms that permit rapid replacement of a depleted collapsible container without ink leakage from either the depleted cartridge or full cartridge that is used as a replacement.

SUMMARY OF THE INVENTION

The present invention is directed to a system that provides a replaceable cartridge for storing ink, in conjunction with a station for securing the cartridge to the printer to facilitate rapid and leak-free replacement of the cartridges.

DESCRIPTION OF PREFERRED EMBODIMENTS

Figure 1:
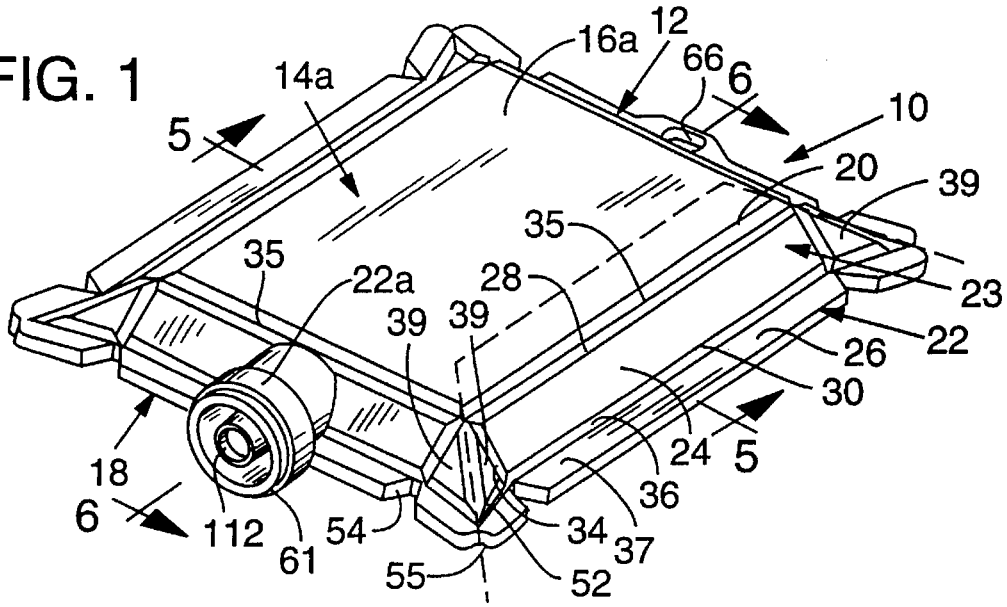
FIG. 1 is a perspective view of a collapsible ink cartridge in accordance with one aspect of the invention.
Figure 2:
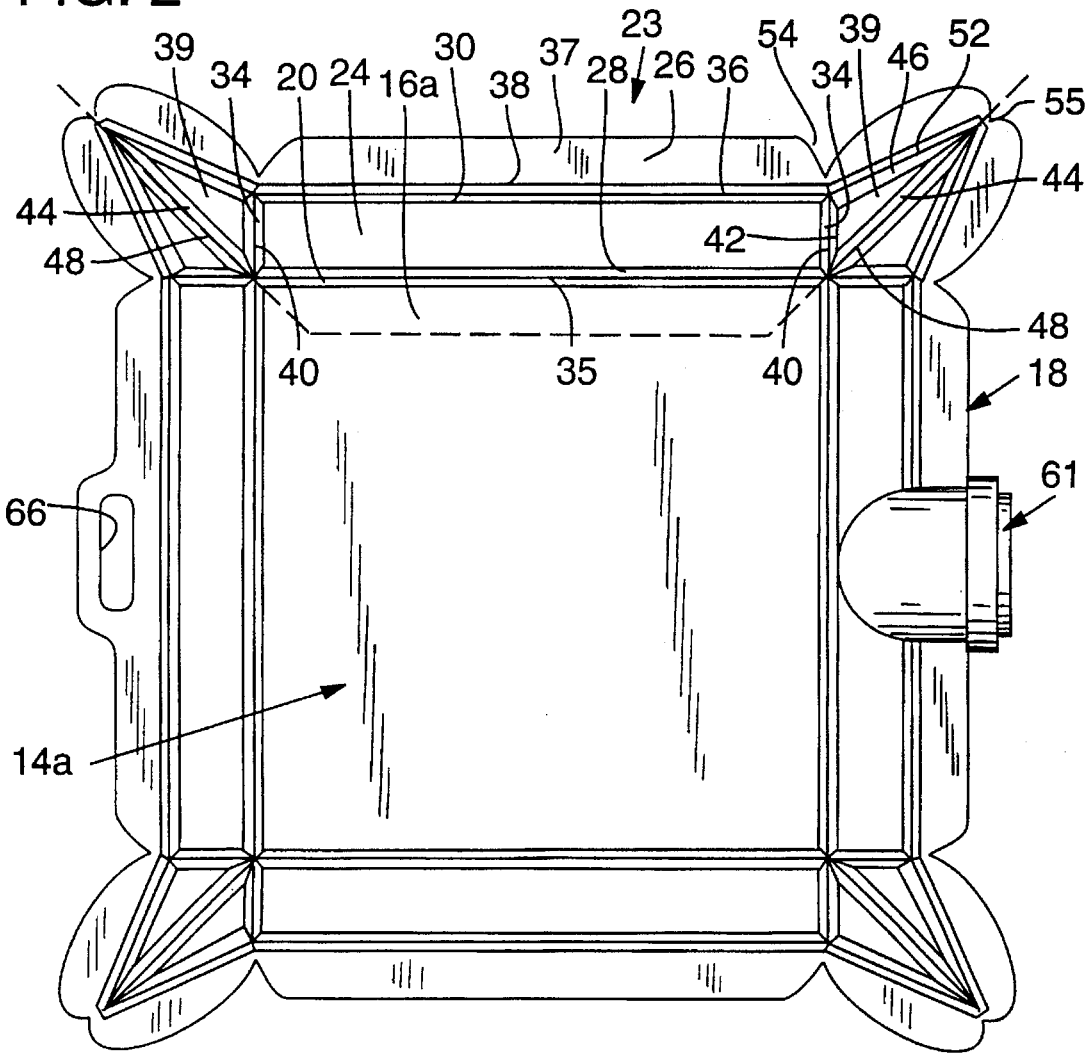
FIG. 2 is a top plan view of the collapsible ink cartridge showing the ink cartridge in a collapsed configuration.

An ink cartridge system in accordance with a preferred embodiment of the present invention includes a collapsible cartridge, as designated in FIG. 1 with reference numeral 10. The ink cartridge 10 includes a body 12 with two substantially identical opposing upper and lower wall panel assemblies 14*a*, 14*b* (see FIG. 3). The opposing wall panel assemblies 14*a*, 14*b* have opposed inner surfaces 15 (see FIG. 5). As shown in FIGS. 1 and 2, each of the panel assemblies 14*a*, 14*b* has a relatively large, square-shaped planar panel 16*a*, 16*b*. The square panels 16*a*, 16*b* respectively define the top and bottom of the cartridge 10. The panel assemblies 14*a*, 14*b* are joined at a square-shaped frame 18 and are, therefore, symmetrical about a central plane defined by the frame 18.

Figure 3:
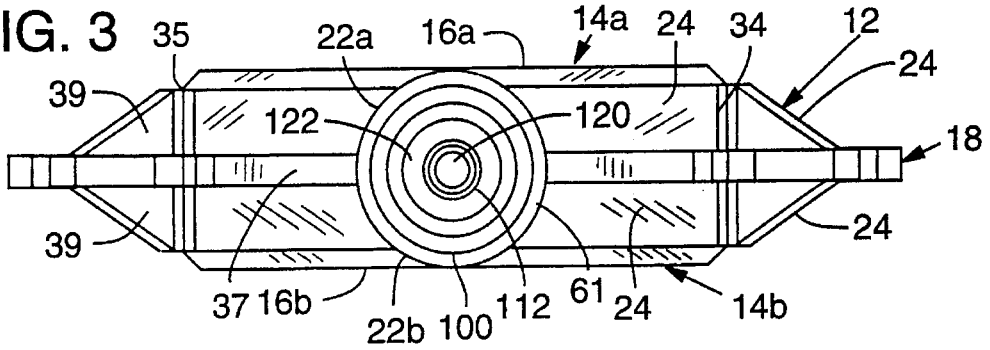
FIG. 3 is a side elevation view of the collapsible ink cartridge.
Figure 4:
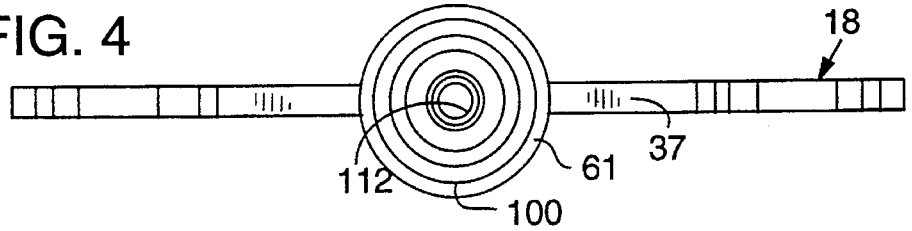
FIG. 4 is a side elevation view of a collapsible ink cartridge showing the ink cartridge in an empty, collapsed configuration.

The cartridge 10 in FIGS. 1 and 3 is shown in a maximum volume or full configuration. In the full configuration, the upper and lower panel assemblies 14*a*, 14*b* extend respectively upward and downward from the frame 18 to define a cavity 19 within the body 12 for the storage of ink (see FIG. 5). The body 12 is collapsible to an empty configuration wherein the upper and lower panel assemblies 14*a*, 14*b* collapse flat against each other within a plane defined by the frame 18 (see FIGS. 2 and 4).

Given the symmetry of the cartridge 10, the following description of the upper panel assembly 14*a* applies equally as well to the lower panel assembly 14*b*.

The upper square panel 16*a* has four identical straight edges 20. The frame 18 has four substantially identical frame side members 22. The square panel 16*a* is positioned with respect to the frame 18 so that the square panel edges 20 align with the frame side members 22. Accordingly, the upper panel assembly 14*a* and the frame 18 have four sides of substantially common construction. One side of common construction is designated by reference numeral 23 and isolated for description purposes by the phantom line of FIGS. 1 and 2. The following description of this side 23 applies equally as well to the other three sides of common construction between the upper panel assembly 14*a* and frame 18.

An elongate rectangular edge panel 24 interconnects the square panel 16*a* and an intermediate portion 26 of the frame side member 22. The rectangular edge panel 24 has inner and outer longitudinal edges 28, 30 and end edges 34. The edge panel longitudinal edges 28, 30 are substantially equal in length to the square panel edge 20. The edge panel inner edge 28 is hinged to the square panel edge 20 at a square panel hinge 35. The edge panel outer edge 30 is hinged to the frame intermediate portion 26 at a double hinge 36. As is described below, the edge panels 24 of the symmetrical upper and lower panel assemblies 14*a*, 14*b* attach to the frame intermediate portion 26 at the double hinge 36 (see FIG. 5).

The edge panel 24 is oriented to extend diagonally between the upper square panel 16*a* and the frame 18 when the cartridge 10 is in the full configuration (see FIG. 3). The edge panel 24 lays flat with the square panel 16*a* within the plane defined by the frame 18 when the cartridge 10 is in the empty configuration (see FIG. 4).

As shown in FIG. 2, a triangular-shaped (corner) panel 39 is attached to each edge panel end edge 34 at an end hinge 40. To facilitate the description of the triangular panels 39, reference is made to FIG. 2, which shows the panels of the first common side construction 23 flat, in the empty configuration. So viewed, the triangular panel 39 has one 45° angle, one obtuse angle, and one acute angle of less than 45°. The shortest (first) edge 42 of the triangle is defined between the 45° and obtuse angles. The longest (second) edge 44 of the triangle is defined between the 45° and acute angles. A third edge 46 of the triangle is defined between the acute and obtuse angles.

The triangular panel first edge 42 is substantially equal in length to the edge panel end edge 34, and attaches thereto at end hinge 40. The second edge 44 of the triangular panel 39 extends radially outward from the corner of the upper square panel 16*a*. In other words, the line defined by the second triangular panel edge 44 diagonally bisects the upper square panel 16*a*. The diagonally bisecting lines defined by both triangular panel second edges 44 of the common side of construction 23 are mutually perpendicular so that the common side of construction 23 forms a 90° "slice" from the upper panel assembly 14*a*.

The triangular panel third edge 46 extends outward from the edge panel outer edge 30. The third edge 46 is hinged to a frame corner portion 50 at a corner double hinge 52. The frame corner portion 50 is set apart from the frame intermediate portion 26 by an outwardly opening frame side notch 54 that aligns with the end hinge 40. The corner double hinge 52 is substantially identical in construction to frame double hinge 36. The corner double hinge 52 connects the symmetric triangular panels 39 of both the upper and lower panel assemblies 14*a*, 14*b* to the frame corner portion 50.

The common side of construction 23 is integrally attached to adjacent common sides of construction at corner hinges 48. One corner hinge 48 hinges each triangular panel 39 of the common side of construction 23 to an identical triangular panel 39 of an adjacent common side of construction. Each hinged pair of triangular panels 39 attach to the corner hinge 48 at their second edges 44 and extend symmetrically therefrom.

Referring to the entire upper panel assembly 14*a* and frame 18 shown in FIG. 2, pairs of hinged triangular panels 39 are positioned at each corner of the upper panel assembly 14*a*. The pairs of triangular panels 39 project beyond the lines formed by the edge panel outer edges 30. The projection of the pairs of triangular panels 39 permits the edge panel outer edges 30 and the triangular panel third edges 46 to remain within the plane defined by the frame 18 in the full and the empty configurations (see FIGS. 1 and 4).

The frame corner portions 50 of adjacent common sides of construction intersect at a corner notch 55. Thus, the corner hinges 48 extend radially from the corners of the upper wall panel 16*a* to the corner notches 55 at the corners of the frame 18.

In the full configuration, as shown in FIGS. 1 and 3, the edge panels 24 are oriented to extend diagonally at an angle of about 35° from the plane of the frame 18. The corner hinges 48 extend upwardly from the corners of the frame corner portions 50 to the corners of the upper square panels 16*a*. The triangular panels 39 of adjacent common sides of construction 23 angle downwardly on either side of the corner hinges 48 to the end hinges 40 and the double corner hinges 52.

The material defining the frame side and corner notches 54, 55 is resilient. The resilient material permits the frame 18 at the notches 54, 55 to resiliently flex during the collapse of the body 12 from the full configuration (FIG. 1) to the empty configuration (FIG. 2).

As will now be described, the hinges 35, 40, 48 and double hinges 36, 52 flex to permit the inner surfaces 15 of the body 12 (see FIG. 5) to lie flat and smooth against each other in the collapsed, empty configuration.

Figure 5:
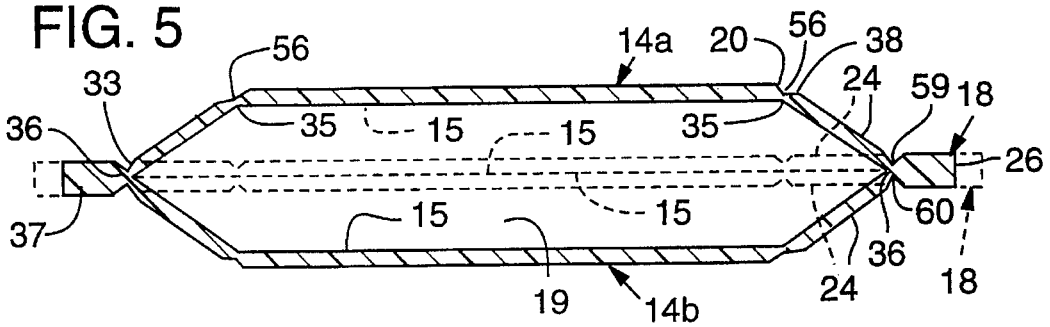
FIG. 5 is a cross-sectional view of a collapsible ink cartridge taken along line 5—5 of FIG. 1.

FIG. 5 shows a cross-section of double hinge 36. The frame intermediate portion 26 and the edge panel outer edge 30 have opposing bevels that form an upper framing groove 59. An identical symmetric lower framing groove 60 is formed between the edge panel 24 of the lower panel assembly 14*b* and the frame intermediate portion 26. A bridge of the frame's resilient material separates the bottoms of the grooves 59, 60. The resilient material flexes to permit the edge panels 24 of the upper and lower panel assemblies 14*a*, 14*b* to pivot together about the frame double hinge 36. The corner double hinge 52 is of similar construction to permit the triangular panels 39 of the upper and lower panel assemblies 14*a*, 14*b* to pivot together.

The hinges 35, 40, 48 between the panels of the common side of construction 23 permit the upper panel assembly 14*a* to collapse flat. FIG. 5 shows a cross-section of an exemplary square panel hinge 35. The hinge 35 includes opposing bevels on the square panel edge 20 and the edge panel inner edge 38 to form a V-shaped hinge groove 56 on the exterior of the panel assembly 14*a*. A narrow bridge of resilient material remains between the bottom of the hinge groove 56 and the inner surface 15 of the panel assembly 14*a*. The panel assembly inner surface 15 is unbroken across the square panel hinge 35.

The edge and corner hinges 40, 48 are of substantially identical construction. Thus, the panel assembly inner surface 15 is completely smooth and flat in the empty configuration. The hinges 35, 40, 48 are identical to the corresponding hinges of the symmetric lower panel assembly 14*b*. Thus, the inner surfaces 15 of both the upper and lower panel assemblies 14*a*, 14*b* are smooth and lie flat against each other in the empty configuration (see phantom in FIG. 5).

The cartridge 10 is filled with ink in the full configuration. One frame intermediate portion 26 is shaped to define a fitment 61 through which ink may be conducted in and out of the cartridge (see FIG. 1). Preferably, the cartridge 10 is molded in the full configuration so that a collapsed cartridge tends to resile toward the full configuration to provide advantages as described below.

Figure 6:
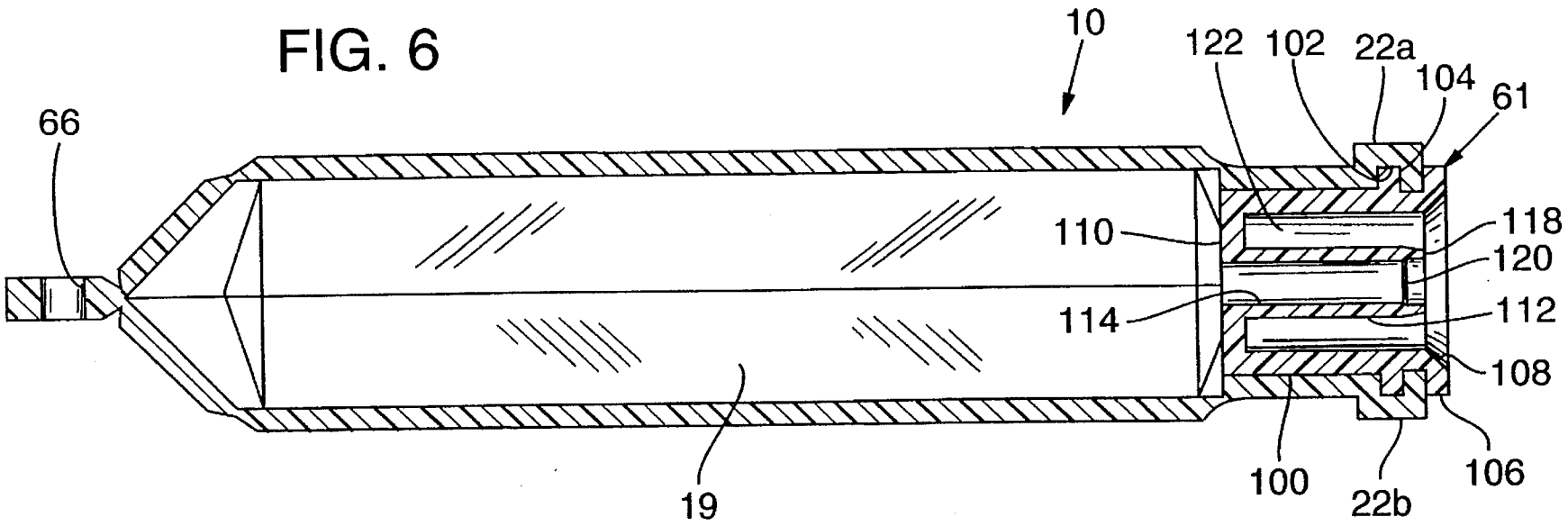
FIG. 6 is a cross-sectional view taken along line 6—6 of FIG. 1 showing the fitment that is carried by the cartridge for facilitating coupling of the cartridge with a member for removing ink from the cartridge.

With particular reference to FIGS. 1 and 6, the fitment 61 includes a cylindrically shaped sleeve 100 that is bonded, as by heat welding, into a correspondingly shaped opening that is molded into one of the side members 22 of the frame 18. In this regard, the frame member is essentially bifurcated into a top part 22*a* and a bottom part 22*b*. The top part 22*a* wraps around the top half of the sleeve 100 and the bottom part 22*b* wraps around the bottom half of the sleeve. In a preferred embodiment, the portion of the frame parts 22*a* and 22*b* facing the sleeve have formed within them a rabbet groove 102 into which fits an annular tongue 104 protruding from the sleeve 100. As noted, the sleeve 100 and frame parts 22*a*, 22*b* are joined by heat welding or, for example, by an adhesive. The outer end 106 of the sleeve is flanged at the edge of the frame parts 22*a*, 22*b*. The interior of that end 106 is chamfered 108 to facilitate mating of the fitment with a coupler, as described below.

The inner end 110 of the sleeve 100 is shaped to define a spout 112 that extends along the axis of the sleeve and protrudes from the inner end 110 to a location inside the outer end 106 of the sleeve. The spout 112 has an inner passage 114 that is open to fluid communication with the cavity 19 of the cartridge 10. Near the outer end 118 of the spout the passage 114 is occluded by a pierceable septum 120 that remains in place until pierced by the coupler as explained below. Accordingly, until the filled cartridge is coupled to the station in the printer, the ink within the cavity 19 is sealed from ambient.

An annular chamber 122 is defined by the fitment to surround the spout 112 inside the sleeve. The chamber extends along the substantial length of the spout (FIG. 6).

Figure 7:
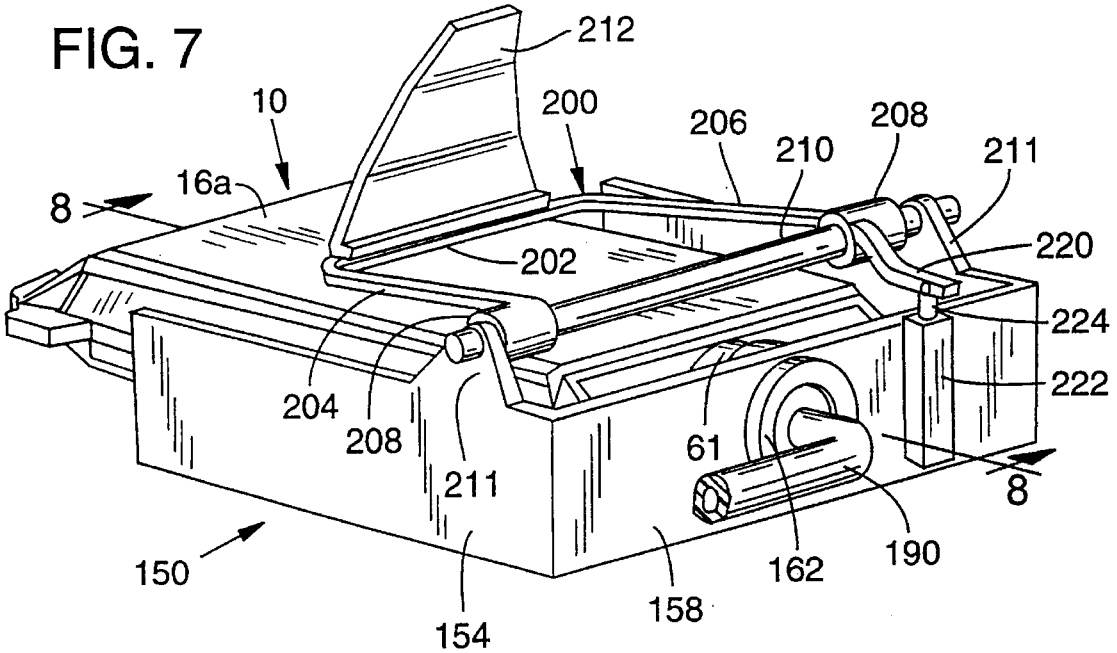
FIG. 7 is a perspective view of a cartridge and printer station made in accordance with the present invention.
Figure 8:
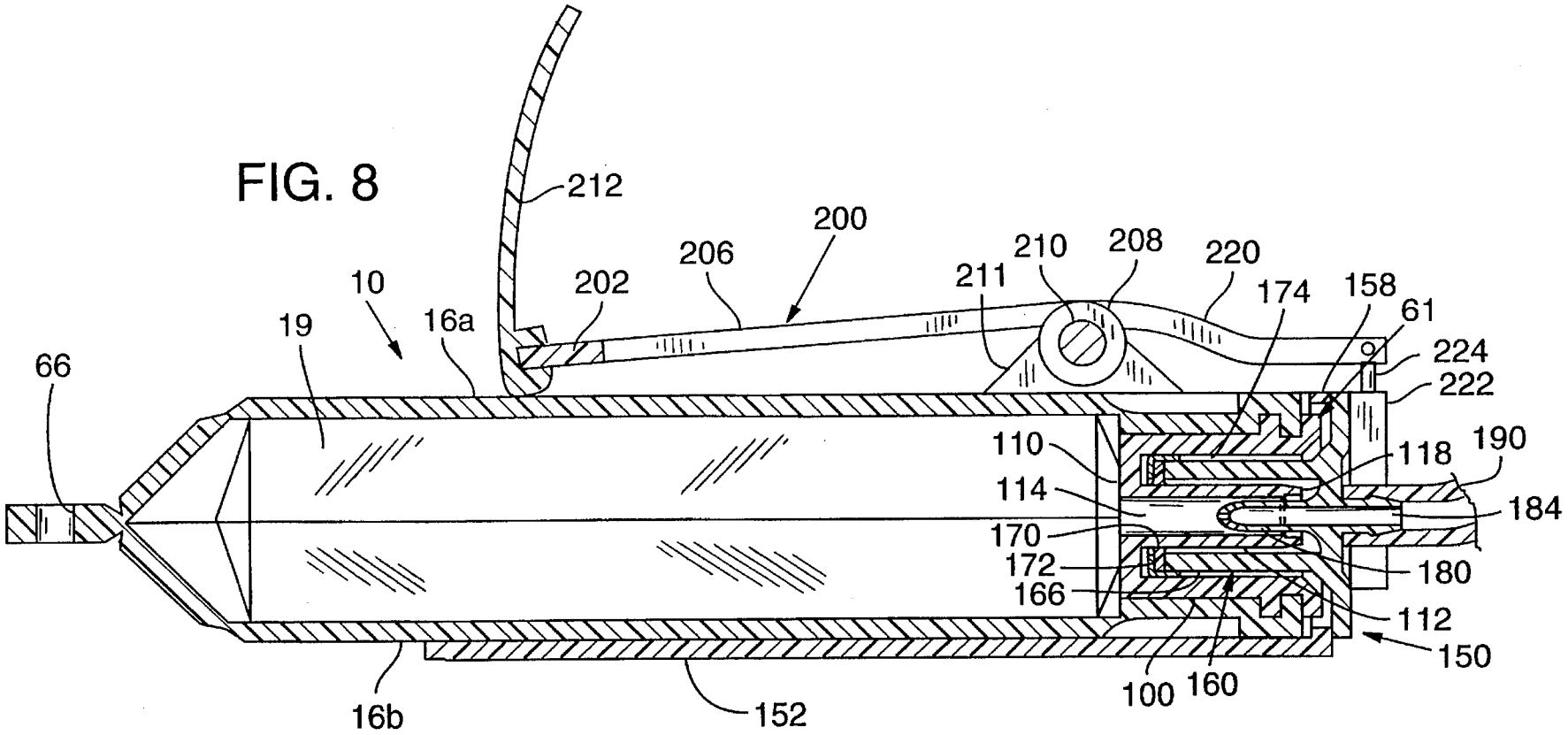
FIG. 8 is a cross-sectional view of the system taken along line 8—8 in FIG. 7.
Figure 9:
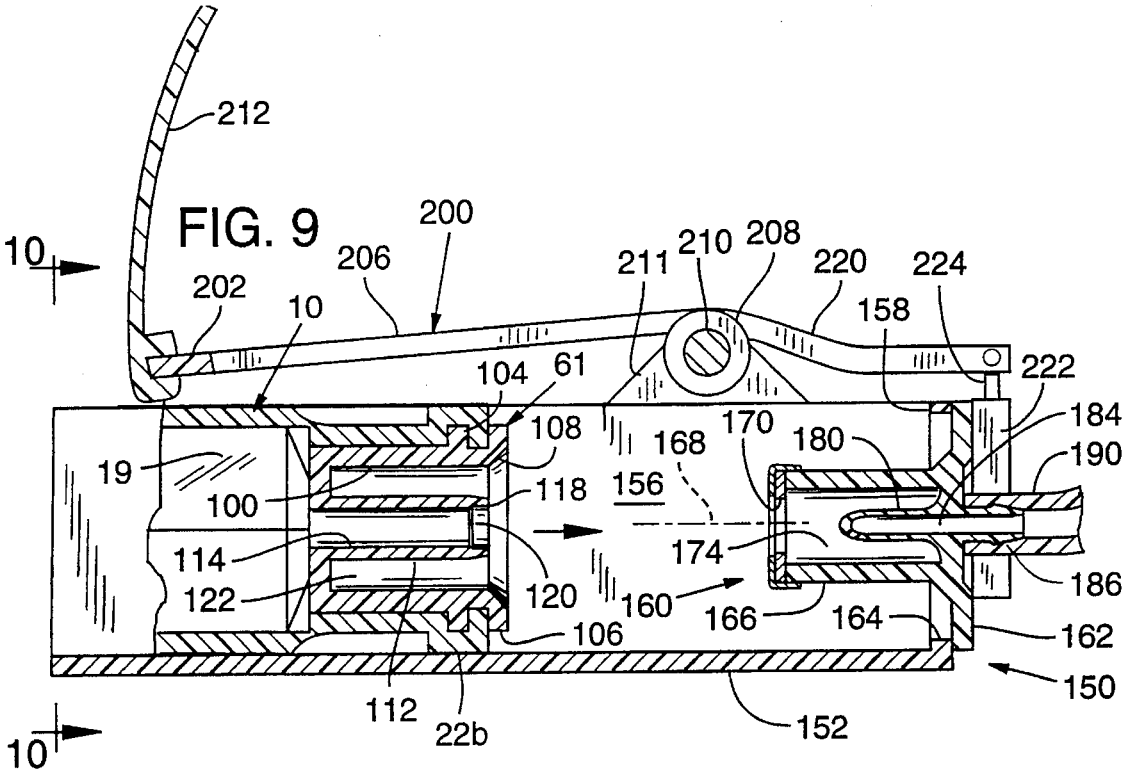
FIG. 9 is a cross-sectional view similar to FIG. 8, except taken when the cartridge is disconnected from the coupling station.
Figure 10:
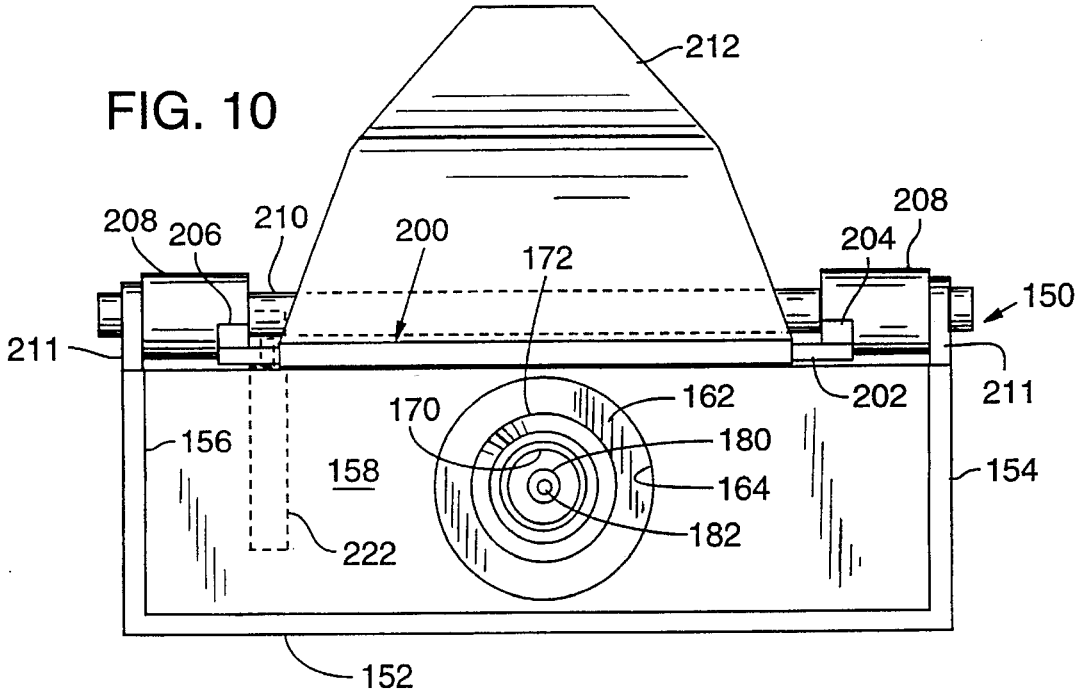
FIG. 10 is a section view taken along line 10—10 of FIG. 9.

With reference to FIGS. 7–9, a cartridge 10 is placed by the user into a station 150 that is carried in the printer. The station 150 includes means for supporting the cartridge 10, coupling the fitment of the cartridge with a tube that conducts the ink from the cartridge to an ink-jet pen, and applying pressure to the cartridge for moving ink from the cartridge through the tube.

More particularly, a preferred embodiment of the station 150 includes a bottom wall 152 onto which may rest the square-shaped panel **16*a* or 16*b* of a cartridge 10. The cartridge 10 fits between two upwardly protruding side walls 154, 156 with the fitment 61 of the cartridge facing an end wall 158 of the station. The end wall 158 has mounted to it the above-mentioned coupler 160**.

As shown in FIGS. 7–10, the coupler 160 includes an annular mounting ring 162 that is fastened across the edge of an aperture 164 formed in the end wall 158 of the station. A generally tubular connector 166 protrudes inwardly into the station, centered along an axis 168 that is spaced from the bottom wall 152 by a distance corresponding to half the thickness of a full cartridge 10. A resilient sealing ring 170 is mounted, such as by swaging with a metal channel member 172, to the innermost end of the connector 166. The resilient sealing ring 170 has an inside diameter slightly less than the outside diameter of the spout 112, thereby to seal the connector interior space 174 to the spout during the time the cartridge 10 is joined to the coupler 160 (FIG. 8).

The coupler 160 is shaped to define a hollow needle 180 that protrudes from the mounting ring 162 inwardly, inside connector 166, for a distance about halfway through the interior space 174 of the connector. The needle 180 includes an orifice 182 formed through its outermost end. The outside diameter of the needle 180 is less than the inside diameter of the passage 114 so that the needle fits inside of the passage. Moreover, when the cartridge fitment is first moved against the coupler, the needle pierces through the septum 120 so that fluid communication is provided between the passage 114 and the interior 184 of the needle, through the orifice 182.

The interior 184 of the needle is contiguous with that of a tube fitting 186 that protrudes outwardly from the mounting ring 162. A flexible tube 190 has one end attached to the tube fitting 186. The other end of the tube 190 may be connectable to the reservoir of an ink-jet pen (not shown) that is reciprocated by a carriage and controlled for directing ink drops onto paper that is advanced through the printer.

In view of the foregoing, it will be appreciated that whenever the cartridge fitment 61 is pushed against the coupler 160, the sealing ring 170 will engage the exterior surface of the spout 112. Preferably, the outermost end 118 of the spout surface is chamfered to facilitate the movement of the sealing ring over the spout. As the spout 112 fits into the interior space 174, the needle 180 is inserted into the spout to pierce through the septum 120, thereby to permit ink to flow from the cartridge cavity 19, through the needle orifice 182, through the needle interior 184, and into the tube 190.

It is noteworthy that the innermost end (that is, to the left in FIG. 9) of the needle 180 is spaced from the sealing ring 170 so that the sealing ring seals against the outer surface of the spout 112 before the needle pierces the septum 120. As a result, any ink that may move from the cartridge to the space between the needle and the interior wall of the spout will be sealed between the spout and the tubular connector 166, and not leak within the station 150.

As explained more fully below, forces tending to push ink from the cartridge 10 are removed whenever the cartridge is removed from the coupler so that the tendency of the cartridge to resile toward its full configuration will create a slight back pressure inside the cartridge, which back pressure will draw into the cartridge any ink that is trapped inside the space 174.

Preferably, the annular space 174 between the needle and the interior wall of the connector 166 is sufficiently small to trap by capillarity any residual ink that moves into that space, so that the ink will not leak from the coupler.

A spring-loaded pressure bar 200 is carried by the station 150 for forcing together the top and bottom of the cartridge to move ink out therefrom. More particularly, the pressure bar 200 is a generally U-shaped member with its base 202 extending across the station between the side walls 154, 156. The legs 204, 206 of the bar extend from opposite ends of the base 202. The ends of the legs 204, 206 each join a spring hinge 208. The spring hinges 208 urge the base 202 toward the bottom wall 152 of the station. The spring hinges 208 are carried by a support rod 210 that extends substantially across the width of the station near the end wall 158. Support brackets 211 are connected between the respective side walls 154, 156 and corresponding ends of the support rod 210 to secure the pressure bar 200 to the station 150.

A thin plastic flag 212 is attached to the base 202. The flag permits the user to pull upwardly against the force of the spring hinges 208 so that a cartridge 10 may be inserted through the space between the bar 202 and the bottom wall 152 of the station. Once the cartridge is in place within the station (that is, with the needle 180 of the coupler 160 engaging the spout 112 as shown in FIG. 8), the flag 212 is released and the bar 202 provides a force tending to push the top wall **16*a* of the cartridge toward the bottom wall 16*b*** so that the bag will collapse as ink is depleted by the pen.

In a preferred embodiment, the downward force of the bar is automatically removed whenever the pen is not being filled; that is, when there is no requirement for forcing ink through the tube 190 to the pen. As noted earlier, removal of the force permits the resilient ink cartridge 10 to move toward the full configuration, thereby establishing a slight back pressure for preventing ink from leaking through the cartridge or through the attached tube 190. Accordingly, lever 220 is attached to extend from one hinge 208 near leg 206 of the bar 202 to protrude generally horizontally across the station end wall 158. A conventional solenoid-type actuator 222 is mounted to the end wall 158 so that the associated extendable and retractable actuator rod 224 is pivotally coupled to the end of the lever 220. A suitable control signal is provided to the actuator 220 whenever the pen requires filling with ink so that the actuator rod 224 will extend upwardly in FIG. 8, thereby releasing the spring hinges 208 to exert the pressure applied by the bar 200.

Figure 11:
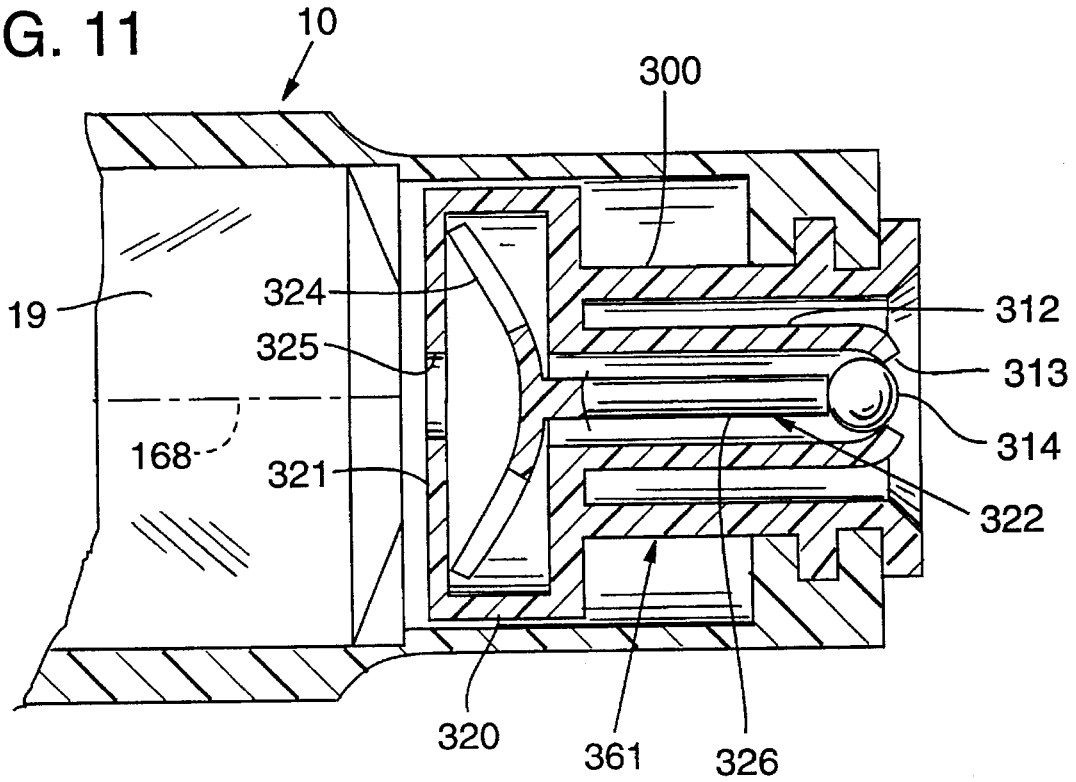
FIG. 11 is a cross-sectional view of an alternative embodiment of a cartridge fitment.

FIG. 11 depicts in cross-section an alternative embodiment of a fitment of the present invention, which fitment is useable with the above-described cartridge 10 and station 150. In this embodiment, the fitment 361 includes a sleeve 300 generally corresponding to the sleeve configuration 100 described above. The spout 312 defined by the sleeve has an outer end that curves inwardly, thereby to define a slightly smaller-diameter opening 313 than the remaining portion of the spout. This spout construction is employed for capturing inside the spout a stainless steel or polyethylene ball 314. The innermost end of the fitment 361 defines a generally cylindrical spring-retaining chamber 320.

A spring 322 is contained within the chamber 320 and normally urges the ball 314 against the outer end 313 of the spout for closing the spout. The spring includes an elongated, normally curved base part 324 and a post 326 integrally formed therewith. The post 326 extends into the spout 312. The outermost end of the spring post 326 engages the ball 314. The outermost ends of the bowed base 324 bear against the inner wall 321 of the fitment portion that defines the chamber 320. An aperture 325 is formed in that wall 321 for defining a path from the cartridge interior cavity 19 through the chamber and out of the spout 312 once the ball is displaced (that is, moved to the left in FIG. 11).

The ball 314 is displaced by the needle 180 of the coupler 160 as it passes into the spout interior. In this regard, the orifice 182 formed in the needle is, for this embodiment, located away from the long axis 168 of the spout so that the orifice will not be occluded as the needle is pushed against the spring-biased ball.

As the ball 314 is pushed from the opening 313, the bow 324 of the spring straightens to permit retraction of the post 326. When the cartridge is removed from the coupler 160, the spring 322 pushes the ball back to the outermost end of the spout thereby to close the spout when the cartridge is disconnected from the coupler.

Figure 12:
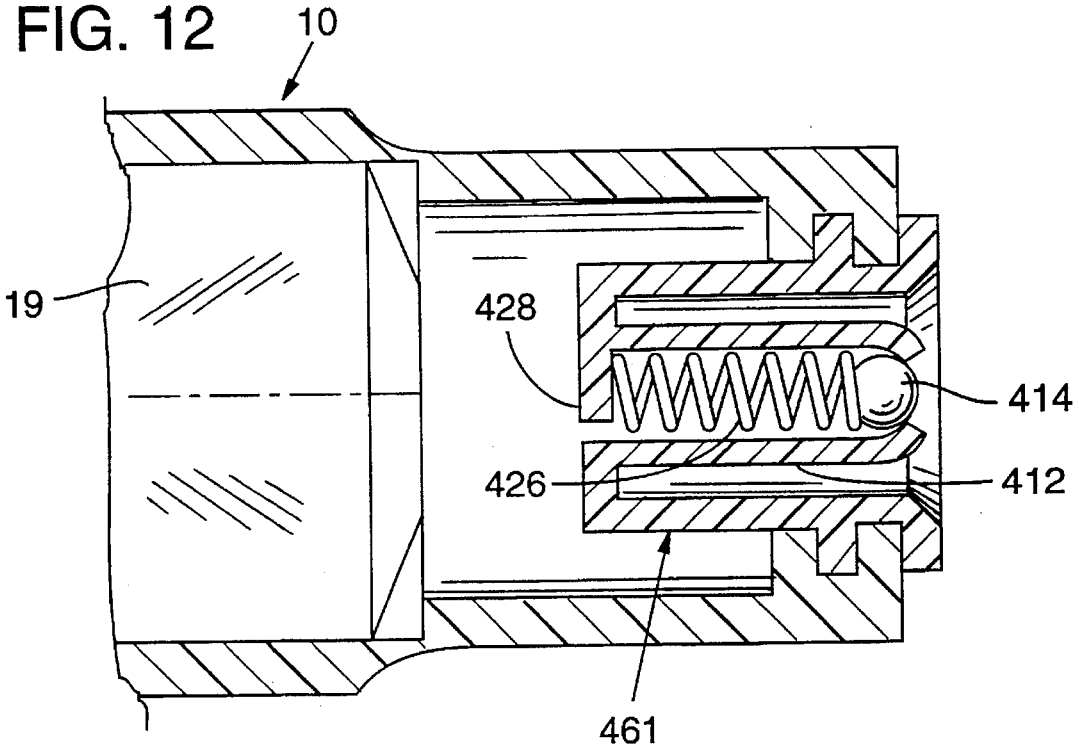
FIG. 12 is a cross-sectional view of another alternative embodiment of the cartridge fitment.

FIG. 12 shows in cross-section another alternative embodiment of a fitment 461 wherein the spout 412 is again shaped at its outermost end to capture within the spout a stainless steel or polyethylene ball 414. In innermost end of the spout includes a bracket 428 that protrudes into the passageway of the spout. A compression spring 426 is fixed inside of the spout, one end of the spring bearing upon the bracket 428, and the other end bearing upon the ball. It will be appreciated that whenever the cartridge 10 is moved to engage the coupler 160, the needle 180 (with eccentric orifice 182) will displace the ball 414 and compress the spring 426, thereby to provide a path for ink flow from the cartridge cavity 19 through the spout 412. Removal of the cartridge from the coupler 162 will permit the spring 426 to return the ball 414 to the outermost end of the spout thereby to close the cartridge to prevent leaking.

The foregoing has been described in connection with preferred and alternative embodiments. It will be appreciated by one of ordinary skill in the art, however, that various modifications and variations may be substituted for the mechanisms and method described here while remaining defined by the appended claims and their equivalents.

The invention claimed is:

1. An ink cartridge system for an ink-jet printer, comprising:

a cartridge for storing ink and having a sealed configuration and an unsealed configuration;

a fitment attached to the cartridge and defining a spout protruding from the cartridge through which ink in the cartridge may flow;

an occluding member carried in the spout and placed in an occluding orientation to normally occlude the spout in the sealed configuration;

a coupler connectable to the spout and defining an interior space within which the spout fits, the coupler being unconnected to the spout in the sealed configuration and wherein the coupler has a sealing member carried thereon for engaging the spout, thereby to seal the interior space between the spout and the coupler when the spout is within the coupler; and a hollow needle member carried within the coupler in the sealed and unsealed configurations and located to displace the occluding member as the coupler and spout are connected, thereby to permit flow of ink from the cartridge through the spout and through the hollow needle member in the unsealed configuration, the coupler being longer than the needle member so the spout enters the interior space before the needle member displaces the occluding member as the coupler and spout are connected.

2. The system of claim 1 wherein the sealing member on the coupler is spaced from the needle member by an amount sufficient for the sealing member to engage the spout before the needle member displaces the occluding member as the coupler and spout are connected.

3. The system of claim 1 further comprising a spring member connected to the fitment for urging the occluding member toward the occluding orientation thereby to occlude the spout as the coupler and spout are disconnected.

4. An ink container comprising:

a collapsible cartridge defining a cavity for containing ink, the cartridge having a plurality of panels that are hingedly connected and formed of a resilient material so as to be urged into a full volume configuration in which at least a slight back pressure is developed within the cartridge, the cartridge being collapsible into an empty, flat configuration, in which the panels are substantially coplanar;

a spout attached to the cartridge, the spout having a passage to allow ink to flow from the cavity; and a sleeve attached to the cartridge and surrounding the spout to define a chamber between the sleeve and the spout, whereby ink that may leak from the spout into the chamber is drawn back into the spout by the back pressure developed within the cartridge.

5. The container of claim 4 wherein the spout is an elongated member, surrounded by the sleeve, the spout being sized so that the spout does not protrude from the sleeve.

6. The container of claim 4 further comprising a displaceable member near the passage that occludes the passage thereby to maintain ink within the cartridge until the displaceable member is displaced.

7. The container of claim 6 wherein the displaceable member is a septum.

8. The container of claim 6 wherein the displaceable member is a ball.

9. The container of claim 8 wherein the displaceable member also includes spring means for urging the ball into a position for occluding the spout.

10. A system for securing to a printer mechanism a collapsible ink cartridge that has a cavity therein for storing ink, comprising:

a station for supporting the cartridge in a connected position;

a coupler mounted to the station and having a connected position, in which the coupler is engaged with the cartridge, the coupler defining a passage for ink to flow from the cartridge cavity whenever the cartridge is in the connected position; and a pressure member carried by the station and including a spring member that forces the pressure member against the cartridge to collapse the cartridge.

11. The system of claim 10 further including a release member attached to the pressure member and movable for automatically removing the force of the pressure member against the cartridge.

12. The system of claim 11 wherein the release member is a stiff, flag-shaped member protruding from the pressure member for manipulation by a user of the system.

13. The system of claim 11 wherein the release member is an actuator including a retractable member attached thereto and actuatable for removing the pressure member from the cartridge.

14. The system of claim 10 wherein a spout is defined on the cartridge, and the coupler comprises a tubular member into which fits the spout, and a needle member carried within the tubular member for insertion into the spout.

15. The system of claim 14 wherein the needle member is spaced from an end of the tubular member by an amount such that the spout fits into the tubular member in advance of the needle member being inserted into the spout.

16. The system of claim 10 wherein the cartridge is constructed of resilient material that urges the cavity toward an expanded volume full configuration.

17. A system for securing to a printer a collapsible ink cartridge that has a cavity therein for storing ink, the system comprising:

a collapsible ink cartridge;

a station configured to support the cartridge in a connected position;

a coupler connectable with the cartridge in the connected position to form an ink flow passage for ink stored within the cavity to flow from the cartridge; and a pressure member engageable with the cartridge in the connected position, and an actuator coupled to the pressure member, the actuator operable by a control signal to automatically actuate the pressure member to apply a force to the cartridge to provide ink flow from the cavity through the passage, and the actuator operable to automatically actuate the pressure member to remove the force from the cartridge to retain ink in the cavity without leakage from the cavity.

18. The system of claim 17, wherein the ink cartridge has a resilient construction which urges the cavity into an expanded volume full configuration.

19. The system of claim 17, wherein at least one of the cartridge and pressure member is configured to establish a back pressure within the cartridge to retain ink within the cavity when the pressure is removed from the cartridge.

20. An ink cartridge system for an ink-jet printer, comprising:

a cartridge for storing ink and having a sealed configuration and an unsealed configuration;

a fitment attached to the cartridge and defining a passage through which ink in the cartridge may flow;

an occluding member carried in the passage and placed in an occluding orientation to normally occlude the spout in the sealed configuration;

a coupler connectable to the fitment and carrying a needle to displace the occluding member in the unsealed configuration, the coupler being unconnected to the fitment in the sealed configuration;

a first seal formed between the coupler and the fitment when the coupler is connected to the fitment; and a second seal formed between the fitment and the needle when the coupler is connected to the fitment, and the coupler and the fitment being configured such that the first seal is formed before the second seal as the coupler is connected to the fitment.

* * * * *